United States Patent [19]

Nishimura et al.

[11] Patent Number: 4,862,779

[45] Date of Patent: Sep. 5, 1989

[54] PUNCHING CUTTER FOR THIN MATERIAL

[75] Inventors: Mizuho Nishimura; Nobuo Watase; Yasunobu Sakaguchi, all of Kanagawa; Mikio Kogane, Tokyo, all of Japan

[73] Assignee: Fuji Photo Film Co., Ltd., Kanagawa, Japan

[21] Appl. No.: 195,313

[22] Filed: May 18, 1988

[30] Foreign Application Priority Data

| | | | |
|---|---|---|---|
| May 28, 1987 | [JP] | Japan | 62-132583 |
| May 28, 1987 | [JP] | Japan | 62-132584 |
| May 28, 1987 | [JP] | Japan | 62-132585 |
| May 28, 1987 | [JP] | Japan | 62-132586 |

[51] Int. Cl.[4] ..... B26D 7/18; B26F 1/44

[52] U.S. Cl. ..... 83/123; 83/102; 83/128; 83/347; 83/539; 83/542; 83/653; 83/685; 83/954

[58] Field of Search ..... 83/124, 125, 126, 128, 83/134, 139, 143, 346, 347, 531, 533, 539, 540, 542, 652, 653, 659, 156, 682, 685, 436, 926 G

[56] References Cited

U.S. PATENT DOCUMENTS

| | | | |
|---|---|---|---|
| 1,048,147 | 12/1912 | Gilbert | 83/539 |
| 2,628,681 | 2/1953 | Kane | 83/347 |
| 3,269,234 | 8/1966 | Talas | 83/542 |
| 4,289,055 | 9/1981 | Von Schriltz | 83/659 |
| 4,412,467 | 11/1983 | De Santo | 83/346 |

FOREIGN PATENT DOCUMENTS

| | | | |
|---|---|---|---|
| 274891 | of 1914 | Fed. Rep. of Germany | 83/653 |
| 743981 | 4/1933 | France | 83/653 |

*Primary Examiner*—Frank T. Yost
*Assistant Examiner*—Scott A. Smith
*Attorney, Agent, or Firm*—Sughrue, Mion, Zinn, Macpeak & Seas

[57] ABSTRACT

A cutter of the present invention comprises a punching member having a punching edge and a receiving member for receiving the punching force of the punching member, the receiving member having a sandwich structure comprising two plate materials and an elastic body held therebetween. Therefore, the receiving member is capable of elastically holding the punching edge during punching.

13 Claims, 6 Drawing Sheets

PUNCHING CUTTER FOR THIN MATERIAL

BACKGROUND OF THE INVENTION

The present invention relates to a punching cutter for cutting thin materials such as photosensitive materials.

In the formation of photographic prints of photographic images, a virgin photographic paper which is wound in the form of a roll is pulled out, and images are printed on the photographic paper from a negative film and developed to form a photographic print which is then cut by using a cutting edge having a straight edge so that the respective images may be separated.

However, in some cases, image portions having a given shape are punched out from a photographic print to form products of the kind mainly used for driver's licenses and ID cards.

In these cases, a cutter provided with a male die having a shape which conforms to a punch-out shape and a female die which receives the male die is required for punching out the image portions on a long photographic print. Such a cutter is therefore rather large in size and high in price, and the dimensions of the engagement between the male die and the female die must be adjusted during the mounting thereof.

For this reason, the inventor has already proposed a thin material-punching cutter which does not require the production of a female die nor adjustment of the dimension when given shapes are punched out from a thin material to form finished products (refer to Japanese Patent Application Nos. 203476 and 203477/1986).

In such a thin material punching cutter, since a punching edge is pressed against a receiving member having the form of a flat plate and the thin material in question is cut while being held, if the stroke of the punching edge is not correctly maintained, precise punching cannot be performed, or the punching edge may be damaged.

SUMMARY OF THE INVENTION

In consideration of the above-described fact, it is an object of the present invention to provide a thin material punching cutter with the capacity to absorb any error in the stroke of a punching edge and which can perform precise punching of a thin material.

A thin material punching cutter of the present invention for punching given shapes in a thin material comprises a punching member which has an annular edge for punching the thin material, and a receiving member which receives the punching force of the punching member and has a surface opposing the annular edge, the latter surface being moved in the direction of the punching member when it punches the thin material and the annular edge being brought into contact with the same surface.

In the present invention, therefore, since the surface of the receiving member opposing the annular edge can be moved while an elastic body is being deformed when the punching edge is pressed against the receiving member, the pressure of punching can be kept at a given value and punching can be performed precisely even if an error is produced in the stroke of the punching edge. In addition, even if the punching edge is not moved straight and is pressed against the receiving member in an inclined state, this inclination can be absorbed, and punching can thus be performed in a precise manner.

DETAILED DESCRIPTION OF PREFERRED EMBODIMENT

Figure 1:
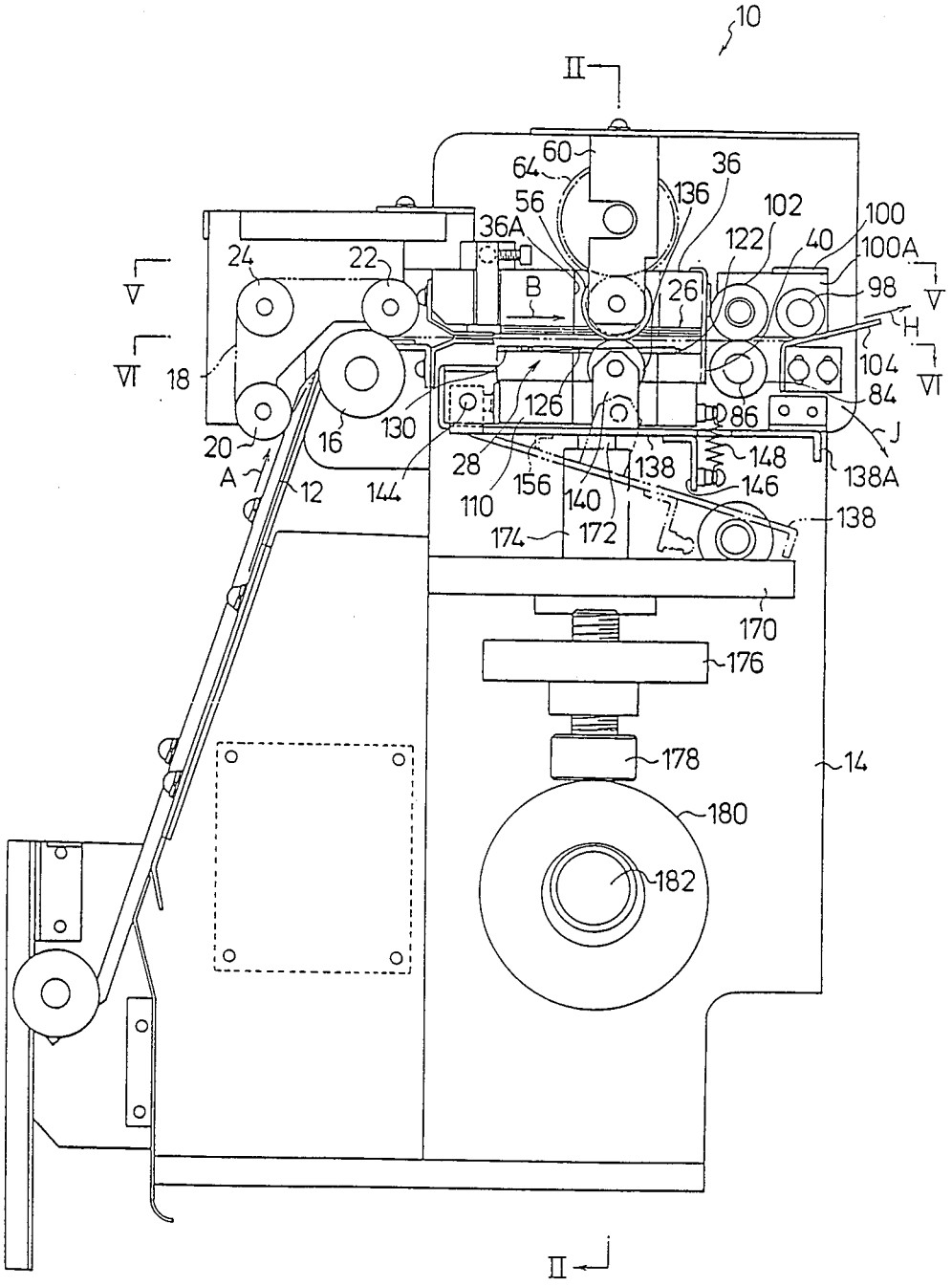
FIG. 1 is a longitudinal sectioned view of a punching cutter to which the present invention is applied.
Figure 2:
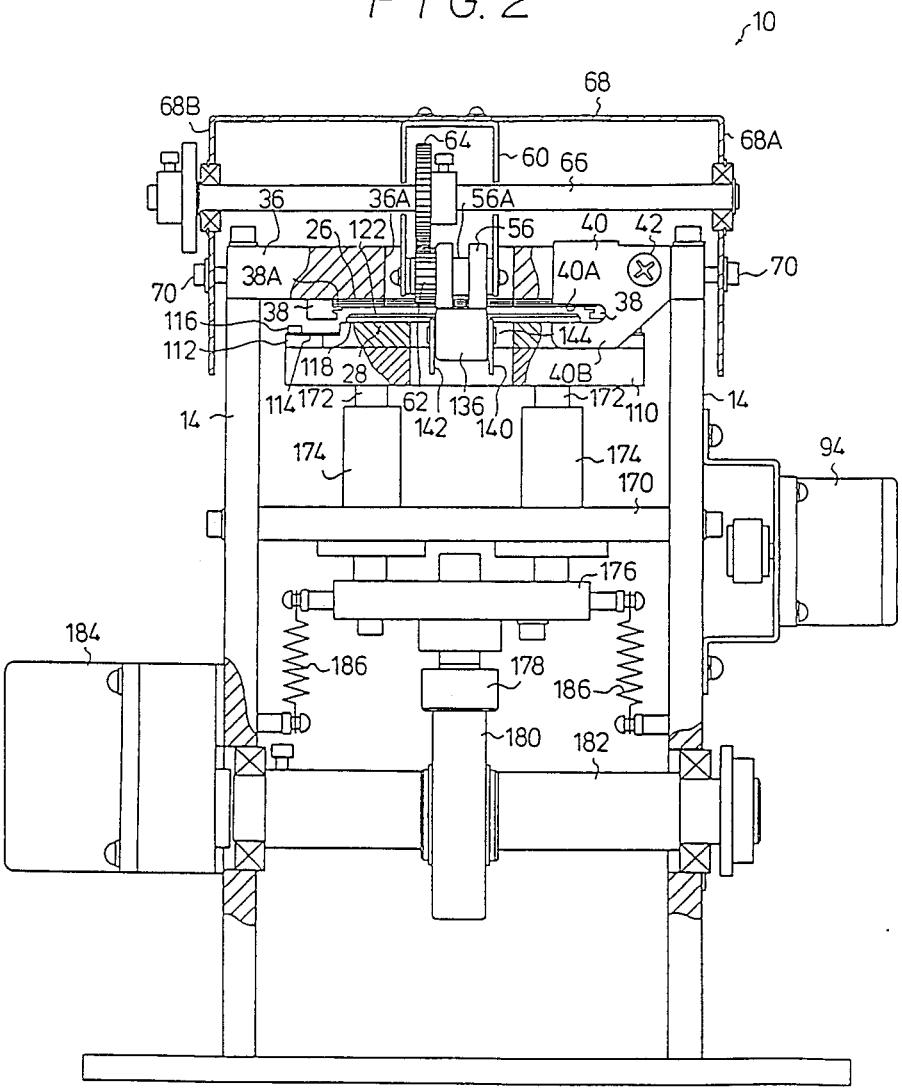
FIG. 2 is a sectional view taken along the line II—II in FIG. 1.

FIGS. 1 and 2 show a cutter of an embodiment to which the present invention is applied. In the cutter 10, a photographic paper 12 which has been previously subjected to the printing and development of images formed thereon in preceding processes (not shown) is carried between two side plates 14 in the direction shown by the arrow A.

A roller 16 is interposed between the two side plates 14, and the photographic paper 12 is pressed against the roller 16 by a pressure belt 18 and then conveyed in the horizontal direction shown by the arrow B. The pressure belt 18 is an endless belt and is wound around rollers 20, 22 and 24, the roller 20 being caused to rotate by the driving force supplied by a motor (not shown).

The photographic paper 12 which emerges from the portion between the roller 16 and the pressure belt 18 is sent to the portion between a receiving member 26 and a punching edge 28.

Figure 4:
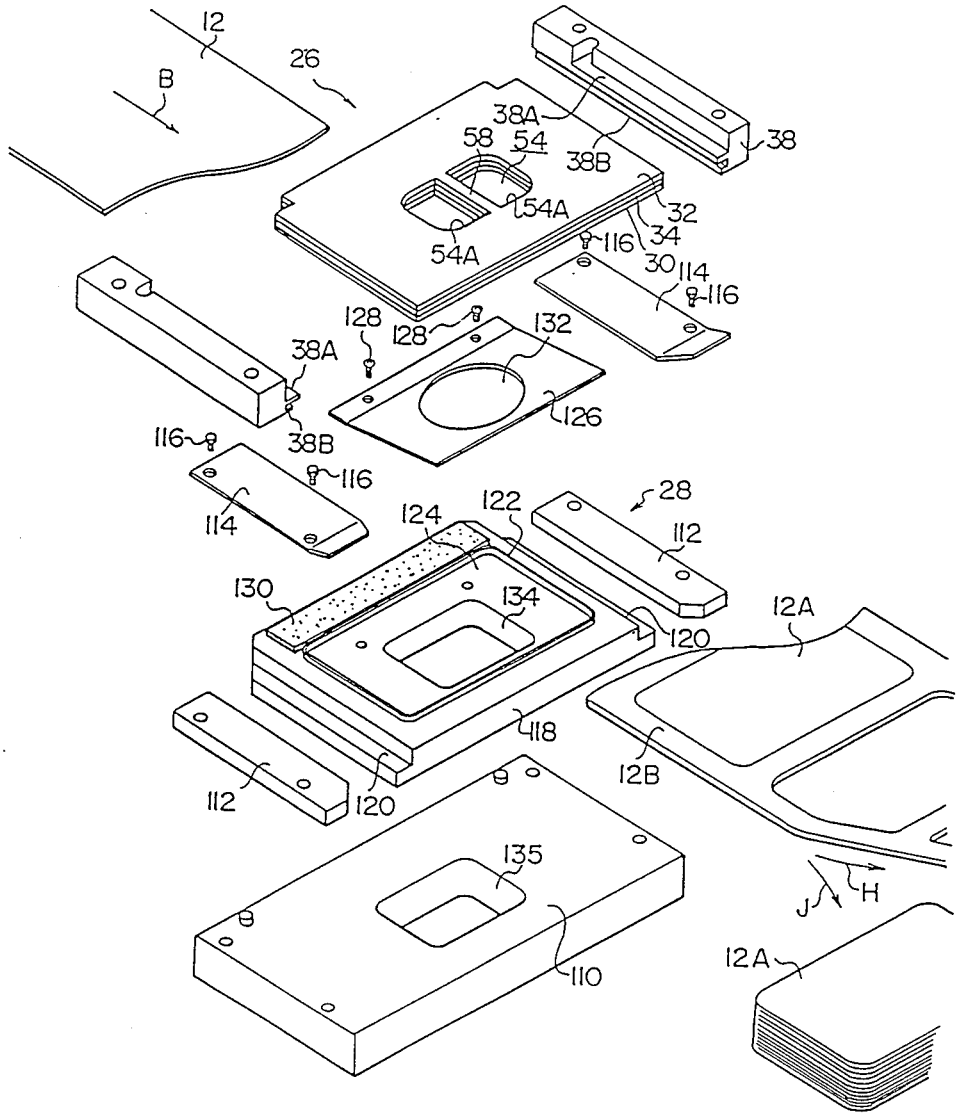
FIG. 4 is an exploded perspective view of a receiving member and a punching edge.

As shown in FIG. 4, the receiving member 26 comprises two support plates 30, 32 which are brought into contact with each other through a rubber plate 34 interposed therebetween, and punching force can be absorbed by the support plate 30 which approaches the support plate 32 while elastically deforming the rubber plate 34.

As shown in FIG. 2, the receiving member 26 is held between an upper supporting board 36 which is horizontally laid across the side plates 14 and two holders 38 which are fixed to the lower surface of the upper supporting board 36. In other words, the two holders 38 are provided parallel to the direction of conveyance of the photographic paper 12 so as to hold a conveyance of the photographic paper 12 as it passes therebetween. The sides of the receiving member 26 are thus held between the upper supporting board 36 and ribs 38A projecting from the opposite surfaces. Therefore, the receiving member 26 can be extracted from the portion between the upper supporting board 36 and the ribs 38A in the direction parallel to the conveyance of the photographic paper 12.

A stopper plate 40 is provided at the end of the upper supporting board 36 on the downstream side of the direction of conveyance of the photographic paper 12 so as to prevent separation of the receiving member 26 mounted between the upper supporting board 36 and the ribs 38A. The stopper plate 40 is pivotally provided on a side surface of the upper supporting board 36 by a machine screw 42 and interferes with one end of the receiving member 26 as viewed in the direction of conveyance of the photographic paper 12 (in FIG. 2) and thus prevents the receiving member 26 from being separated. In this state, a notch 40A is formed in the stopper plate 40 so as to prevent the passage of the photographic paper 12 from being inhibited.

Figure 3:
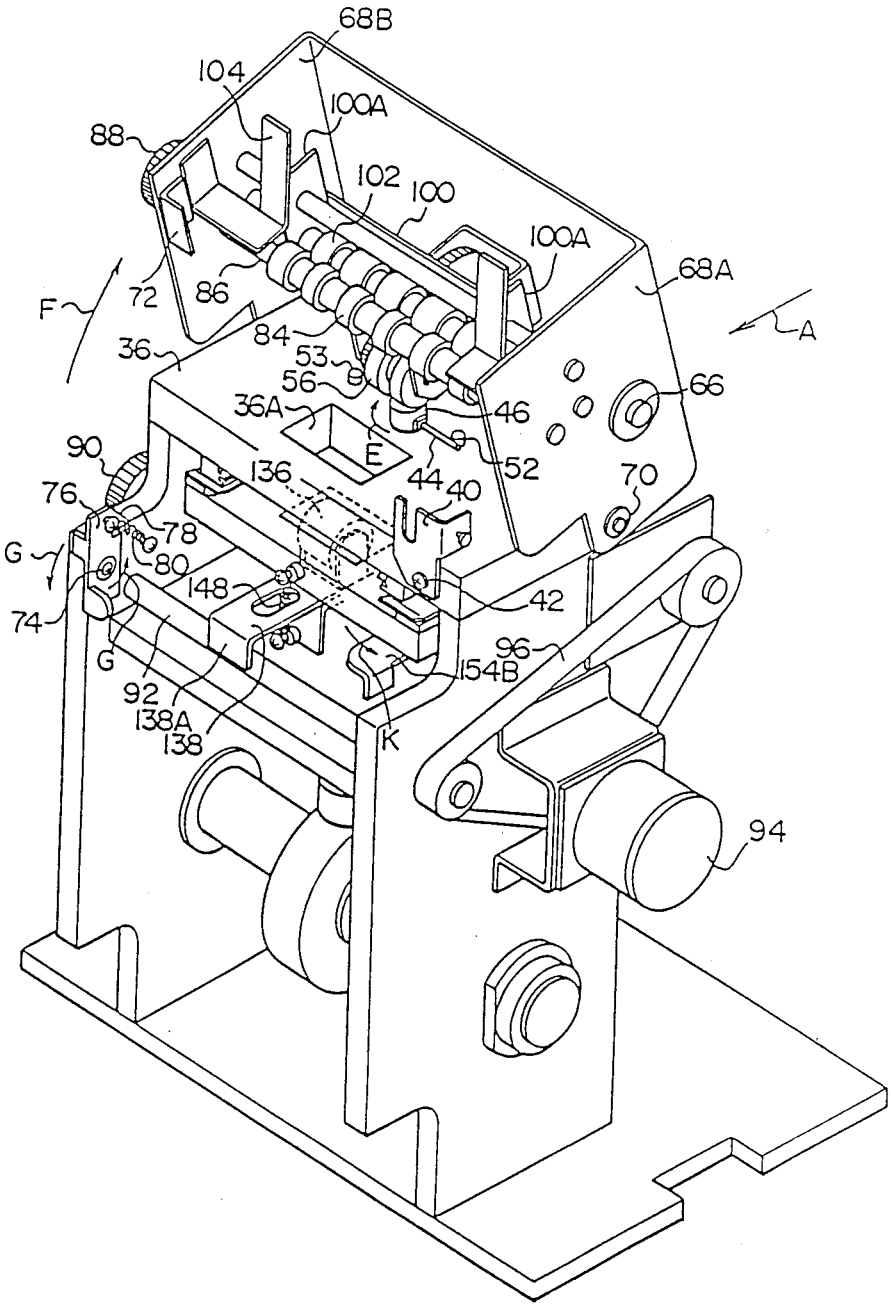
FIG. 3 is a perspective view of the cutter in the state wherein a rotary bracket is lifted.
Figure 5:
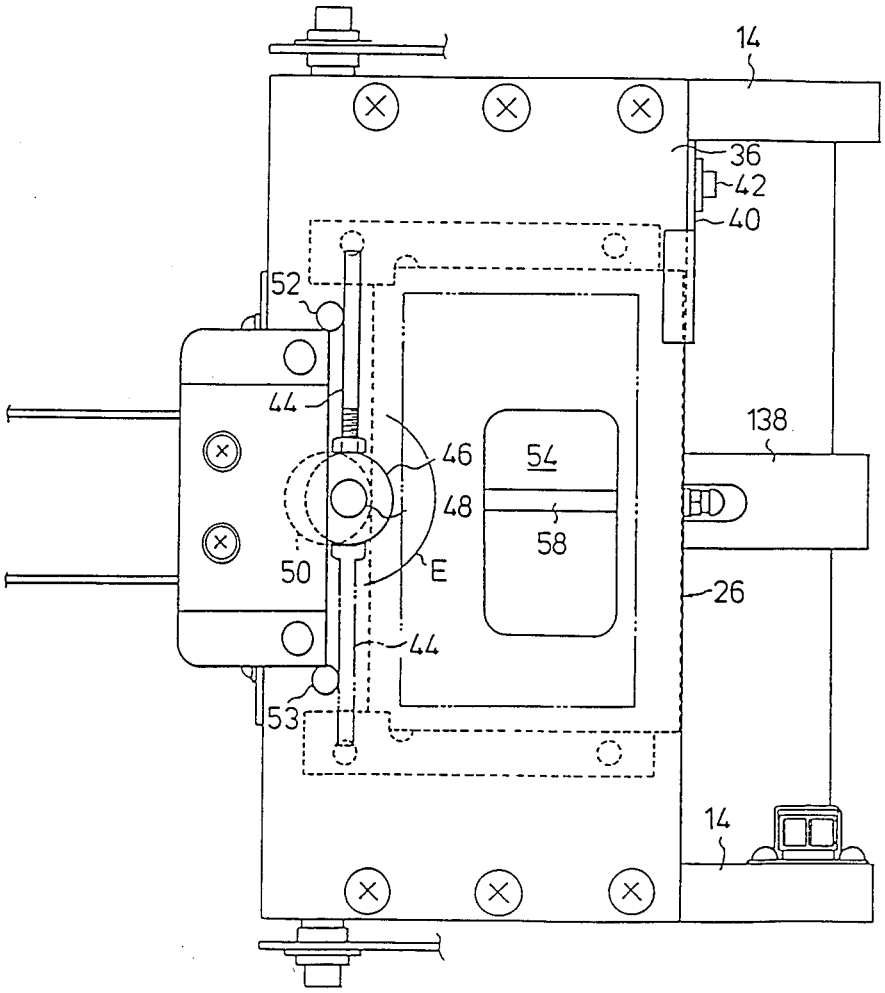
FIG. 5 is a sectional view taken along the line V—V in FIG. 1.

As shown in FIGS. 3 and 5, the upper supporting board 36 is provided with a receiving member pushing lever 44 on the upper surface thereof. The receiving member pushing lever 44 is projected from the periphery of a cylindrical body 46 in the radial direction thereof, the cylindrical body 46 being fixed to the upper end of a rotational shaft 48 which passes vertically through the upper supporting board 36. An eccentric cam 50 is fixed to the other end of the rotational shaft 48 which projects downwardly from the upper supporting board 36 and has its periphery in contact with one end of the receiving member 26.

Therefore, when the receiving member pushing lever 44 is rotated together with the rotational shaft 48 in the direction shown by the arrow E, the eccentric cam 50 can push out the receiving member 26 in the direction of travel of the photographic paper 12. In the state wherein the receiving member pushing lever 44 is in contact with a stop pin 52 projected from the upper supporting board 36, the receiving member 26 can be inserted normally. When the lever 44 is rotated in the direction shown by the arrow E until it is brought into contact with a stop pin 53, the eccentric cam 50 can be rotated to the state wherein the receiving member 26 is pushed out to its extreme.

As shown in FIGS. 2 and 4, each of the holders 38 has a rib **38*b* which is provided under each of the ribs 38 and projects in parallel therewith, and the side ends of the photographic paper 12 are respectively received in the spaces between the ribs 38A and the ribs 38B. Thus, the side ends of the photographic paper 12** can be properly guided and correctly positioned.

As shown in FIG. 4, the receiving member 26 has a through hole 54 in which a feed roller 56 (shown in FIGS. 1 and 2) is inserted. This feed roller 56 is brought into contact with the photographic paper 12 placed under the receiving member 26, and has the function of applying feed driving force to the punched portions 12A after the photographic paper 12 has been punched.

Therefore, the upper supporting board 36 also has an opening 36A in which the feed roller 56 is pivotally provided on both legs of a U-shaped bracket. A gear 62 is concentrically fixed to the feed roller 56 and engages with a gear 64. This gear 64 is fixed to a rotational shaft 66 which is laid across leg plates 68A, 68B of a rotary bracket 68 to which the U-shaped bracket 60 is fixed.

The leg plates 68A, 68B are pivotally provided on the upper supporting board 36 by means of bolts 70 to allow them to rotate to the state shown in FIG. 3 in the direction shown by the arrow F. In the state shown in FIG. 3, the feed roller 56 is extracted from the through hole 54 of the receiving member 26, but when the rotary bracket 68 is rotated in the direction opposite to that shown by the arrow F, the feed roller 56 passes through the opening 36A of the upper supporting board 36 and enters the through hole 54 of the receiving member 26. When the rotary bracket 68 is rotated to assume the state shown in FIGS. 1 and 2, as shown in FIG. 3, an L-shaped plate 72 engages with a hook 78 of a stopper 76 which is pivotally attached to the inside of one of the side plates 14 by means of a machine screw 74 so that the rotary bracket 68 can be prevented from rotating unnecessarily.

The state of engagement between the hook 78 and the stopper 76 can be assuredly maintained by an extension coil spring 80. Therefore, when an operator attempts to rotate the rotary bracket 68 around the bolts 70 in the direction shown by the arrow F, the hook 78 may be rotated against the urging force of the extension coil spring 80 in the direction shown by the arrow G.

A ring groove 56A is formed in the feed roller 56 at the center in the axial direction thereof so as to avoid a guide portion 58 which is laid across the through hole 54 of the receiving member 26 in the direction of travel of the photographic paper. The through hole 54 is divided into two portions by the guide portion 58 at the center thereof so that, if the photographic paper being sent in the direction shown by the arrow B is curled, the end thereof is not caught by an end surface 54A of the through hole 54.

A holding carriage roller 84 is pivotally provided between the leg plates 68A, 68B and contacts the lower surface of the photographic paper 12 which emerges from the portion between the receiving member 28 and the punching edge 28. A shaft 86 of the holding carriage roller 84 projects from the leg plate 68B, and a gear 88 (shown in FIG. 3) is fixed to the end of the shaft. The gear 88 is adapted to engage with a gear 90 which is pivotally provided on the outside of one of the side plates 14 in the state shown in FIGS. 1 and 2 wherein the rotary bracket 68 is loaded. The gear 90 engages with a gear (not shown) which is fixed to one end of a rotational shaft 92 laid across the side plates 14, part of a timing belt 96 being passed around the other end of the rotational shaft 92 on the outside of the opposite side plate 14 and driven by a motor 94.

A support shaft 98 is laid across the leg plates 68A, 68B in parallel with the holding carriage roller 84, and parallel leg plates 100A of a rotary bracket 100 are pivotally provided on the support shaft 98. A holding carriage roller 102 is pivotally provided on the rotary bracket 100. The holding carriage roller 102 can be put into contact with the holding carriage roller 84 in the state shown in FIGS. 1 and 2, and is pressed against the holding carriage roller 84 by the urging force of an elastic body (not shown) so that the photographic paper 12 that has been punched is held between the holding carriage rollers 102, 84 and a carrying force is applied to the photographic paper 12 by the driving force of the holding carriage roller 84.

Each of the holding carriage rollers 84, 102 is an uneven roller in which large-diameter portions and small-diameter portions are alternately formed, and the large-diameter portions of one of the holding carriage rollers enter the small-diameter portions of the other roller to some extent so that the punched portions 12A are easily separated from a portion 12B remaining after the punching. However, these rollers may be replaced by straight rollers having no unevenness if desired.

Two guide plates 104 are respectively fixed to the leg plates 68A, 68B so as to guide both sides of the portion 12B remaining after the punching of the punched portions 12A and send it in the direction shown by the arrow H. After the remaining portion 12B has been sent in the direction shown by the arrow H, it is cut into pieces or rolled up and then discarded. The punched portions 12A fall through the portion between the two guide plates 104 under their own weight in the direction shown by the arrow J.

A group of gears (not shown) which applies a driving force to the rotational shaft 66 from the gear 88 is provided on the outside of the leg plate 68A.

The punching edge 28 is mounted on an elevating stand 110 which is horizontally disposed, and plate springs 114 are fixed by machine screws to the upper ends of blocks 112 which are fixed to both sides thereof. One end of each of these plate springs 114 is projected over the blocks 112 such that they approach each other and brought into contact with notches 120 formed in an outer frame 118 of the punching edge 28, thereby to press the outer frame 118 against the elevating stand 110 and hold it in place.

A moving edge body 122 is received within the outer frame 118. This moving edge body 122 is formed by bending a long plate material to form a rectangular frame, and is fixed between the outer frame 118 and an inner frame 124 which is forced into the space formed by outer frame 118. An edge of the edge body 122 at the upper end thereof projects above the upper end of the inner frame 124 so as to punch the portions 12A to be punched on the photographic paper 12 when pressed against the receiving member 26 as it is raised.

A plate spring 126 is fixed to the top surface of the inner frame 124 at one end thereof. The plate spring 126 is gradually bent toward the other end in the direction in which it separates from the inner frame 124 and, in a free state, is upwardly bent above the end of the moving edge body 122, i.e., it approaches the path of the photographic paper 12 closer than the end of the moving edge body 122.

Therefore, when the punching edge 28 is raised to punch an intermediate portion of the photographic paper 12, the plate spring 126 is elastically bent and enters a portion below the upper end of the moving edge body 122 so that the action of punching is not interrupted. However, when the punching edge 28 is separated from the receiving member 26 and reaches a lower portion, the plate spring 126 is elastically restored and projects above the upper end of the moving edge body 122 so as to push the punched portions 12A out of the moving edge body 122.

A sponge plate 130 is pasted on the outer frame 118 on the upper side of the moving edge body 122, the upper end of the sponge plate 130 projecting above the top of the moving edge body 122. When the end of the photographic paper 12 is moved along the path thereof in the direction shown by the arrow B, the sponge plate 130 has the function of guiding the end of the photographic paper 12 in the portion between the moving edge body 122 and the receiving member 26 without pressing the end against the moving edge body 122. However, when the receiving member 26 and the punching edge 28 are stuck against each other, the sponge plate 130 is also elastically bent so that the action of punching is not interrupted.

A circular through hole 132 and rectangular through holes 134 and 135 are formed in the plate spring 126, the inner frame 124 and the elevating stand 110, respectively, so that a feed roller 136 may be passed therethrough. This feed roller 136 is pivotally provided between erect plates 140, 142 of the rotary bracket 138 shown in FIGS. 1, 2 so as to be freely rotatable.

The feed roller 136 is pivotally provided on the elevating stand 110 by means of a pin 144 at one end thereof, and a portion in the vicinity of the other end thereof forms an operating portion 138A. A spring stop piece 146 is fixed to an intermediate position on the rotary bracket 138, and a extension coil spring 148 is interposed between the spring stop piece 146 and the elevating stand 110, as shown in FIG. 1. As a result, the feed roller 136 is passed through the rectangular through holes 134, 135 and the circular through hole 132 and is pressed against the feed roller 56.

When the rotary bracket 138 is rotated clockwise as viewed in FIG. 1, the feed roller 136 is extracted from the circular through hole 132 and the rectangular through hole 134 so that the punching edge 28 can be extracted in the direction shown by the arrow B.

Figure 6:
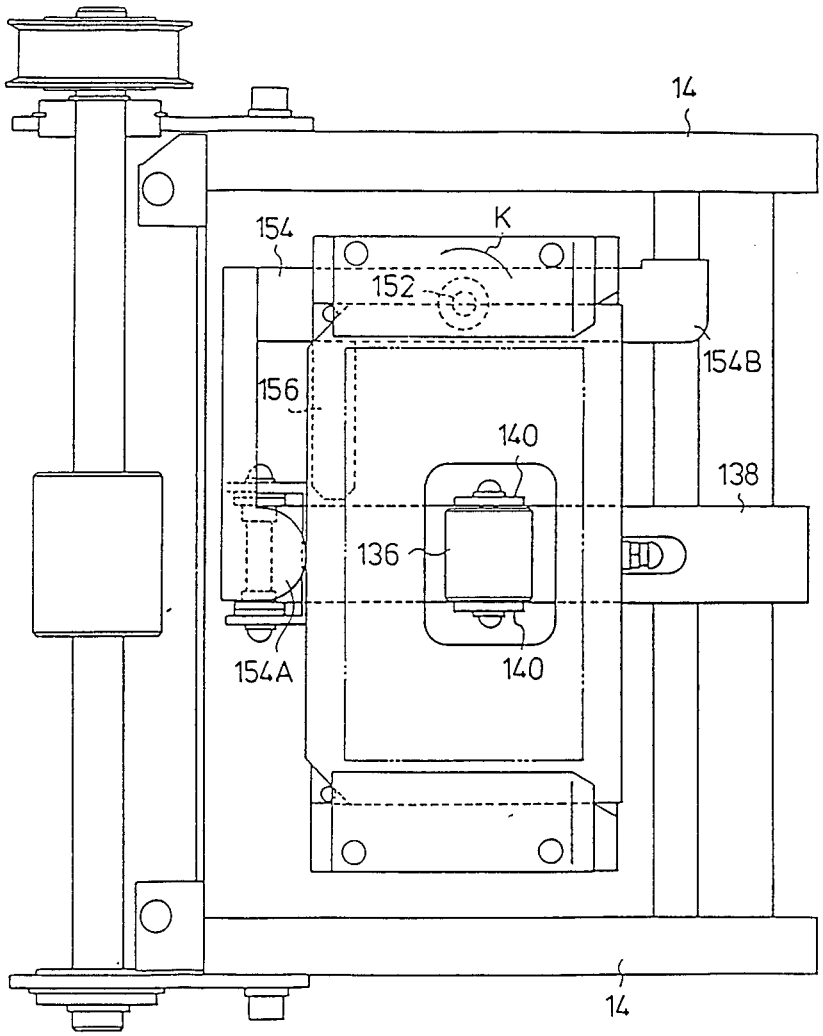
FIG. 6 is a sectional view taken along the line VI—VI in FIG. 1

Therefore, a rotational lever 154 is pivotally provided on a lower portion of the elevating stand 110 by means of a pin 152 at an intermediate position, as shown in FIG. 6. One end of the rotational lever 154 serves as a pressure portion 154A which is brought into contact with the path of the photographic paper 12 on the upstream side, and the other end serves as an operating portion 154B which projects to the downstream side of the path of the photographic paper 12 beyond the elevating stand 110. Thus, when the rotational lever 154 is rotated in the direction shown by the arrow K in FIG. 6, the pressure portion 154A pushes the punching edge 28 out from the elevating stand 110 in the direction shown by the arrow B.

However, a stopper plate 40 which prevents the receiving member 26 from being separated is provided so as to prevent any unnecessary separation of the punching edge 28 in the state shown in FIGS. 1, 2 and 6. This allows the punching edge 28 to be correctly mounted on the elevating stand 110. In other words, as shown in FIG. 2, a projecting portion 40B below the notch 40A in the stopper plate 40 interferes with one end of the punching edge 28 as viewed in the direction of travel of the photographic paper so as to prevent the punching edge 28 from being extracted in the direction shown by the arrow B.

In addition, a stopper 156 projects between the pressure portion 154A and the pin 152 of the rotational lever 154, as shown in FIG. 6. When the rotational lever 154 is rotated in the direction shown by the arrow K in FIG. 6, the stopper 156 enters a portion above the rotary bracket 138 which is rotated clockwise around the pin 144 so as to maintain the state wherein the rotary bracket 138 is moved downward, as shown by the phantom lines in FIG. 1.

A lower support stand 170 is horizontally laid across the side plates 14 in a lower portion of the elevating stand 110. Guide sleeves 174 which are projected downward from the elevating stand 110 are fixed to the lower support stand 170. An elevating plate 176 is horizontally fixed to the lower end of elevating shafts 172 which are projected downward from the guide sleeves 174, and an elevating block 178 is fixed to the elevating plate 176. The elevating block 178 is mounted on a cam 180 which is fixed to a cam shaft 182 laid across the side plates 14. The cam shaft 182 is rotated by the driving force received from a motor 184 which is fixed to the outside of one side plate 14 so that the elevating stand 110 is longitudinally moved together with the punching edge 28 through the elevating shafts 172.

Since extension coil springs 186 are interposed between the elevating plate 176 and the side plates 14, the elevating plate 176 receives a force acting in the direction in which it is pressed against the cam 180. However, the extension coil springs may be removed so that the elevating plate 176 moved downward under its own weight.

A description will now be made of the function of the embodiment.

After images have been printed and developed in the preceding processes (not shown), the photographic paper 12 is first sent in the direction shown by the arrow A, then sent in the direction shown by the arrow B while being passed between the roller 16 and the pressure belt 18, and finally sent to the portion between the receiving member 26 and the punching edge 28.

When the motor 184 is rotated here, the elevating shafts 172 are raised together with the elevating stand 110 by virtue of the rotation of the cam 180. Thus, the punching edge 28 is pressed against the receiving member 26. Thus, the portions 12A to be punched are punched out of the photographic paper 12 and separated from the remaining portion 12B. At the same time, the plate spring 126 is elastically bent and enters the moving edge body 122.

During the action of punching, the support plate 30 which is pressed by the moving edge body 122 is moved while compressing the rubber plate 34 and thus any excessive stroke of the moving edge body 122 is absorbed, whereby punching can be performed precisely. In this way, the pressing force of the punching edge 28 applied to the receiving member 26 is absorbed by the elastic deformation of the rubber plate 34, this enabling the support plates 30, 32 which must be made of a relatively flexible metal (brass) or synthetic resin in conventional cutters to be made of a hard material such as a stainless plate. In addition, since the receiving member can be reversed so that the support plate 32 is brought into contact with the punching edge 28, the life of the cutter can be doubled. In other words, the lifetime of a conventional cutter which is equivalent to about 5000 operations can be increased to the equivalent of about 20,000 operations by using a stainless plate and the back and front sides of the receiving member.

After punching, when the motor 184 is further rotated, the punching edge 28 is separated from the receiving member 26 by the rotation of the cam 180 and downwardly moved. During the downward movement, the plate spring 144 is projected in the moving edge body 122 so that the punching portions 12A does not remain in the moving edge body 122 even if the punched portions 12A are completely cut and separated from the remaining portion 12B.

Since the feed roller 56 receives the driving force of the motor 94, it is rotated clockwise as shown in FIG. 1 to send the photographic paper 12 in the direction shown by the arrow B. In this case, since the feed roller 136 is freely rotatable, the feed roller 136 is also rotated in synchronism with the feed roller 56 to send the photographic paper 12.

During the movement of the photographic paper 12, the end of the photographic paper 12 and the end surfaces of the punched portions 12A vertical to the direction of travel are brought into contact with the inner periphery of the circular through hole 132 formed in the plate spring 126. However, since the circular through hole 132 has a circular form, the photographic paper 12 is not caught by the circular through hole 132 even if the end of the photographic paper 12 and the remaining portion 12B is curled. In addition, since the guide portion 58 is formed at the center of the through hole of the receiving member 26, the end of the photographic paper or the remaining portion 12B is not caught by this through hole.

The punched portions 12A and the remaining portion 12B which emerges from the portion between the feed roller 56 and the feed roller 136 are further sent in the direction shown by the arrow B while being held between the holding carriage roller 84 and the holding carriage roller 102, separated by the guide plate 104, and sent in the directions shown by the arrows H and J, respectively.

A description will now be made of a repairing work such as the replacement of the receiving member 26 and the punching edge 28.

When the stopper is firstly rotated around the machine screw 74 in the direction shown by the arrow G against the urging force of the extension coil spring 80, the hook 78 is separated from the L-shaped plate 72. Thus, the rotary bracket 68 is made rotatable in the direction shown by the arrow F in FIG. 3. Therefore, when the rotary bracket 68 is rotated around the bolts 70 to be raised, the holding carriage roller 84, the holding carriage roller 102 and the feed roller 56 are raised together with the rotary bracket 68, as shown in FIG. 3.

When the stopper plate 40 is rotated around the machine screw 42 so as to assume the state shown in FIG. 3, the receiving member 26 and the punching edge 28 can be extracted. Therefore, when the receiving member pushing lever 44 is rotated in the direction shown by the arrow E in which the lever moves from the stop pin 52 to the stop pin 53, the eccentric cam 50 pushes the receiving member 26 out of the holders 38.

On the other hand, when the punching edge is extracted, the rotary bracket 138 is rotated clockwise as shown in FIG. 1, and the rotational lever 154 is rotated counterclockwise as shown in FIG. 6 while the state of the rotated rotational lever 154 being kept, the pressure portion 154A of the rotational lever 154 pushes the punching edge 28 out from the elevating stand 110 in the horizontal direction, as well as the stopper engaging with the rotary bracket 138 so as to inhibit the rising of the rotary bracket 138.

Therefore, the receiving member 26 and the punching edge 28 can be removed and replaced by new receiving member 26 and punching edge 28. After the replacement and mounting have been completed, the new receiving member 26 and punching edge 28 can be normally mounted by the operation reverse to the above-described operation. When the punching edge 28 is mounted on the elevating stand 110, the pressure portion 154A is pushed by the punching edge 28 and thus rotated around the pin 152 in the direction opposite to that shown by the arrow E. Since the stopper 156 is also disengaged from the rotary bracket 138, the rotary bracket 138 is restored by the extension coil spring 148 so that the feed roller 136 is returned to the opening 36A.

In this way, during repairing, the feed roller 56 and the feed roller 136 are moved in the direction in which they are separated from the carriage path of the photographic paper and then the receiving member 26 and the punching edge 28 are extracted in parallel with the photographic paper to be carried (in the direction of travel of the photographic paper in this embodiment). Therefore, the receiving member and the punching edge can be easily handled. In other words, since the feed roller 56 and the feed roller 136 are separated upwardly and downwardly from the receiving member 26 and the punching edge 28, respectively, and the receiving member 26 and the punching edge 28 are extracted in the horizontal direction, though the feed roller 56 and the feed roller 136 enter the receiving member 26 and the punching edge 28, respectively, the receiving member 26 and the punching edge 28 can be easily and rapidly repaired.

The feed roller 56 can be extracted from the receiving member 26 by being rotated together with the rotary bracket 68, as shown in FIG. 3, as well as being so configured that it is upwardly retracted in the vertical direction. The feed roller 136 may also be configured so as to be downwardly retracted in the vertical direction. In addition, the receiving member 26 and the punching edge 28 can be extracted along the direction of travel of the photographic paper, as well as being so configured that it is extracted in the horizontal direction in the plane containing the photographic paper carried between the receiving member 26 and the punching edge 28 in the direction shown by the arrow B.

What is claimed is:

1. A thin material punching cutter for punching given shapes in a thin material carried along a carriage path comprising:

a punching edge having an annular edge for punching said thin material and being disposed on one side of said carriage path so as to be movable toward the other side thereof;

a receiving member which receives the punching force of said punching edge, said receiving member including two plate materials and an elastic body held therebetween, and being disposed on said other side of said carriage path so that one of said two plate materials is opposite to said edge; and a feed roller respectively provided on each side of said carriage path so as to pass through the insides of said receiving member and said edge of said punching member and which hold said thin material.

2. A thin material punching cutter according to claim 1, wherein said elastic body comprises a rubber plate.

3. A thin material punching cutter according to claim 1, wherein a plate spring for pushing out the portions punched in said thin material from said edge is fixed to the inside of said edge of said punching member.

4. A thin material punching cutter according to claim 1, wherein said plate spring has a through hole through which the feed roller that passes through said punching member can pass, and which has a dimension in the widthwise direction of said thin material which is smaller on the downstream side in the direction of travel of said thin material than that on the upstream side.

5. A thin material punching cutter according to claim 1, further comprising a roller guide means for separating said two feed rollers from said carriage path.

6. A thin material punching cutter according to claim 5, wherein said roller guide means comprises a first separating means for separating one of said two feed rollers from said carriage path, and a second separating means for separating the other feed roller from said carriage path.

7. A thin material punching cutter for punching given shapes in a thin material carried along a carriage path comprising:

a machine bed;

a punching member which is supported by said machine bed on one side of said carriage path so as to be movable in the direction of punching of said thin material and which has an annular edge for punching said thin material;

a drive means for driving said punching member in said direction of punching of said thin material;

a receiving member, which has a sandwich structure comprising two plate materials and an elastic body held therebetween, is supported by said machine bed on the other side of said carriage path so that one of said two plate materials is opposite to said edge, and receives the punching force of said punching member; and a feed roller respectively provided on each side of said carriage path so as to pass through the insides of said receiving member and said edge of said punching member and which hold said thin material.

8. A thin material punching cutter according to claim 7, wherein said elastic body is made of a rubber plate.

9. A thin material punching cutter according to claim 7, wherein a plate spring for pushing out the portions punched in said thin material from said edge is fixed to the inside of said edge of said punching member.

10. A thin material punching cutter according to claim 9, wherein said plate spring has a through hole through which the feed roller that passes through said punching member can pass, and which has a dimension in the widthwise direction of said thin material which is smaller on the downstream side in the direction of travel of said thin material than that on the upstream side.

11. A thin material punching cutter according to claim 7, further comprising a roller guide means for separating said two feed rollers from said carriage path.

12. A thin material punching cutter according to claim 11, wherein said roller guide means comprises a first separating means for separating one of said two feed rollers from said carriage path, and a second separating means for separating the other feed roller from said carriage path.

13. A thin material punching cutter according to claim 11 further comprising an extraction means for extracting said punching member and said receiving member from said machine bed by moving said punching member and said receiving member along the plane of said carriage path.

* * * * *